US005749503A

United States Patent [19]

Wulf et al.

[11] Patent Number: 5,749,503

[45] Date of Patent: May 12, 1998

[54] CONVERTIBLE LUGGAGE SYSTEM

[75] Inventors: Katherine Wulf, Vista; Richard Steven Barker, Escondido, both of Calif.

[73] Assignee: Eagle Creek, Inc., San Marcos, Calif.

[21] Appl. No.: 625,392

[22] Filed: Mar. 27, 1996

[51] Int. Cl.[6] ..... A45F 4/02; A45C 5/14

[52] U.S. Cl. ..... 224/153; 224/583; 224/580; 224/627; 224/633; 224/644; 224/652; 224/657; 190/18 A

[58] Field of Search ..... 224/153, 581, 224/582, 583, 652, 653, 627, 637, 657, 644, 633; 190/18 A, 18 R, 108, 109; 280/10, 8

[56] References Cited

U.S. PATENT DOCUMENTS

| | | | |
|---|---|---|---|
| 4,066,195 | 1/1978 | Dickler | 224/153 |
| 4,368,835 | 1/1983 | Murphy . | |
| 4,524,482 | 6/1985 | Mueller . | |
| 4,563,777 | 1/1986 | Park . | |
| 4,593,841 | 6/1986 | Lange . | |
| 4,883,207 | 11/1989 | McArthur . | |
| 4,887,751 | 12/1989 | Lehman . | |
| 4,961,522 | 10/1990 | Weber | 224/153 |
| 4,995,487 | 2/1991 | Plath . | |
| 5,022,574 | 6/1991 | Cesari . | |
| 5,167,306 | 12/1992 | Carrigan, Jr. | 190/18 A |
| 5,447,261 | 9/1995 | Mitomi et al. | 224/153 |
| 5,560,524 | 10/1996 | Brune | 224/153 |

FOREIGN PATENT DOCUMENTS

| | | | |
|---|---|---|---|
| 2454773 | 12/1980 | France | 190/18 A |
| 1238303 | 7/1971 | United Kingdom | 224/153 |

*Primary Examiner*—Linda J. Sholl

*Attorney, Agent, or Firm*—Phillips, Moore, Lempio & Finley

[57] ABSTRACT

A luggage container which conveniently converts for use as wheeled suitcase, a backpack and a hand-carry bag having a first and second compartment for storage of belongings. A pair of wheels are rotatably mounted to an axle which is at an edge along the bottom of the first compartment. A pair of shoulder straps are provided in the second compartment and are concealed by a cover. When the container is used as a backpack, the cover is opened to reveal the shoulder straps. The cover is wrapped over the wheels and secured to the bottom side of the first compartment. In this manner the traveler and the traveler's belongings are protected when cartage is on the traveler's back from filth that accumulates on the wheels.

18 Claims, 4 Drawing Sheets

42
29
46
72
74
76
48
38
52
56
37
34
50
54
61
51
10
12
14
22
44
26
18
20
30
68
40
16
24

CONVERTIBLE LUGGAGE SYSTEM

FIELD OF THE INVENTION

This invention relates generally to luggage containers used as a wheeled suitcase, backpack and hand-carry bag.

BACKGROUND OF THE INVENTION

As life styles become increasingly mobile and time becomes more essential, there is a growing interest among travelers for luggage which is easily adaptable to changing needs. To meet these demands, luggage should be able to quickly convert to a wheeled suitcase, a backpack and a hand-carry bag. While in transit, a traveler may often need to push or pull heavy luggage across the ground. At times, the traveler may also need to carry the same luggage up and down stairs or over uneven terrain. There are other instances when the traveler may desire to carry the luggage on his or her back, for example, in order to free the hands for carrying other additional items. Therefore, the luggage should easily convert to adapt to these varying travel conditions.

During instances when the luggage is used as a backpack, it is important for the traveler's clothes and belongings be protected from particles and liquid, i.e. water, mud, etc. which may have accumulated on the wheels. Furthermore, it is desirable for the straps to be kept relatively free of debris and liquid that may otherwise have accumulated on the straps while the luggage is rolled or hand-carried, thereby ensuring the straps do not leave dirt on the traveler's shoulders.

Previous attempts at convertible luggage include Murphy, U.S. Pat. No. 4,368,835 which discloses a backpack with exposed straps and a pair of wheels along one side of its lower end. In Murphy, the wheels are made very small so as to avoid contacting the user's back. However, disadvantages to this configuration include limited weight bearing capabilities and mobility constraints.

A wheeled utility bag is disclosed in Cesari, U.S. Pat. No. 5,022,594. The wheels are mounted to the underside of the bag such that the bag sits upright. This bag, however offers no protection for the user from debris on the wheels.

Lange, U.S. Pat. No. 4,593,841 discloses a wheeled pack cart with fully exposed straps. Lange is configured with removable wheels to address the issue of protection from the wheels. When the wheels are not in use, they are removed from the bottom of the cart and stored in the cart. The wheels are disassembled by removing a hairpin retaining clip from an axle, removing one wheel and sliding the axle and the other wheel out of a housing. The traveler, however, may find the manual removal and reinsertion of the wheel assembly in Lange inconveniently cumbersome and time-consuming.

In McArthur, U.S. Pat. No. 4,883,207, a pair of shoulder straps are hidden by a flap in the luggage. When opened, the flap is tucked into a sealable pouch. McArthur does not include wheels for rolling the luggage or indicate how one would incorporate wheels into this configuration.

None of the prior art discloses luggage which easily and quickly converts to the wheeled, hand-carry and backpack formats and additionally offers protection to the user. No prior inventions describe luggage with a cover which is closed to conceal shoulder straps when in one format and when in another format, is opened to reveal the straps and to secure over a pair of wheels.

SUMMARY OF THE INVENTION

It is an object of the present invention to provide luggage offering the versatility of selectively being used in backpack, hand-carry and wheeled formats. The invention has a first compartment to hold belongings, a second compartment attached to the first compartment. The second compartment contains a pair of shoulder straps, therewithin. The invention also includes a pair of wheels rotatably mounted along an axle. The axle is affixed to a first edge of the first compartment.

A further object of the present invention is to provide luggage capable of conveniently being converted from the hand-carry format, to the wheeled format and to the backpack format. To achieve this end, the luggage includes a padded cover which conceals the shoulder straps when used in the hand-carry and wheeled formats. When the luggage is used in the backpack format, the cover is easily opened, thereby exposing the shoulder straps and covering the wheels.

Another object of the present invention is to provide luggage which allows for protection of the traveler from filth which may collect on the luggage. Thus, the above mentioned cover is secured over the second compartment to shield the straps from environmental conditions when the luggage is in the wheeled or hand-carry format. In this manner the traveler is ensured that the straps are free from debris when placed over the shoulders. The cover additionally encase the wheels when the luggage is in the backpack format to protect the traveler from grime that has attached to the wheels.

Other objects and advantages of the present invention will become apparent when the luggage of the present invention is considered in conjunction with the accompanying drawings, specification and claims.

DESCRIPTION OF THE PREFERRED EMBODIMENT

Figures 1, 2:
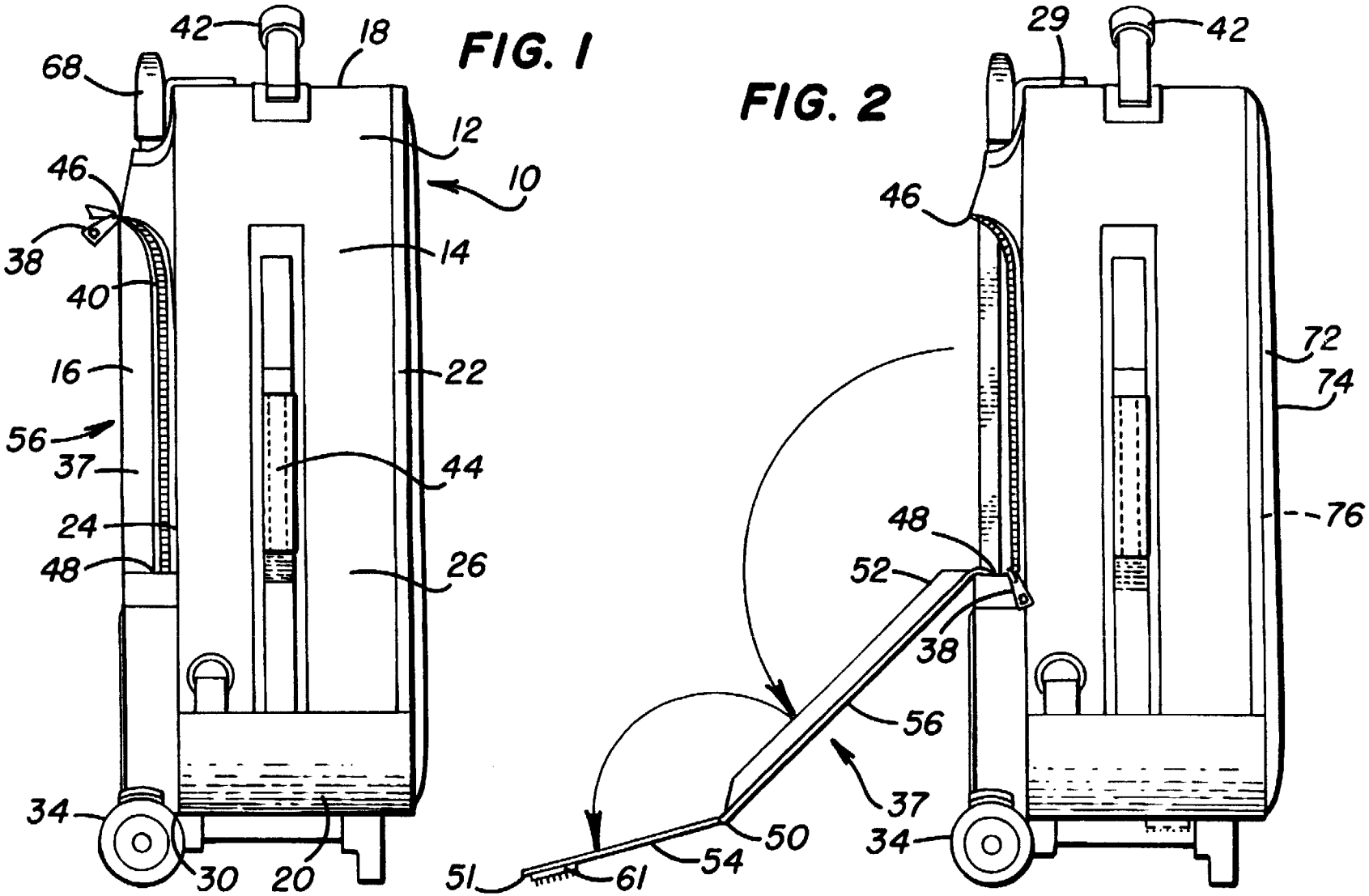
FIG. 1 is a side view of the article of luggage in its hand-carry format with the first cover closed.
FIG. 2 is a side view of the article of luggage with the first cover opened.

FIG. 1 shows the luggage 10 of the present invention comprising a luggage body 12 formed of any convenient durable material, such as plastic, including vinyl, canvas fabric, nylon, leather, etc. The luggage body 12 comprises at least a first compartment 14 and a second compartment 16.

The first compartment 14 is defined by a top 18, bottom 20, front side 22, back side 24, first side 26, and second side 28. The first and second sides 26, 28 are shown most clearly in FIG. 3. The first compartment is closed by an openable closure 29 located on the top, first or second sides of the first compartment, and preferably on the top. The openable closure 29 is any conventional closure to seal the first compartment. The first compartment also has a first edge 30.

Figure 3:
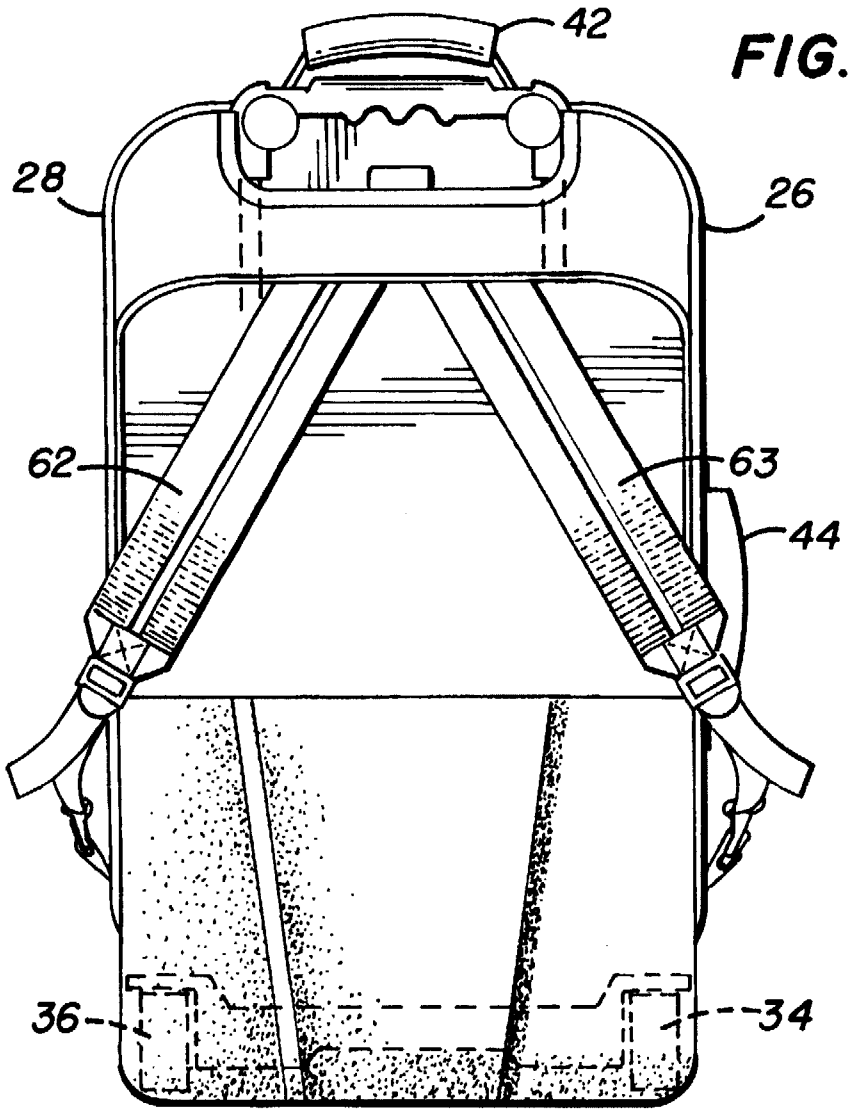
FIG. 3 is a back view of the article of luggage in its backpack format with its cover opened and fastened to the bottom.

At the first edge 30, the luggage includes an elongated axle 32, affixed thereon. A pair of wheels 34, 36 are rotatably mounted to the axle, with one wheel 34 mounted to one end of the axle and another wheel 36 mounted to the opposite end of the axle. The wheels and axle are best shown in FIG. 3.

The second compartment 16 is affixed to the first compartment's back side 24. When the luggage is in the hand-carry format, as shown in FIG. 1, a first cover 37 encloses the second compartment 16. In a preferred hand-carry embodiment, the cover 37 is secured in a closed position by a slide fastener 38 on the second compartment 16, such as a zipper, a pinch lock similar to enclosures on zip-lock bags, or the like. The slide fastener extends from a top edge 46 of the second compartment to a bottom edge 48 of the second compartment. The slide fastener attaches to a cover fastener 40 along the perimeter of the cover, thus, sealing the cover against the second compartment.

Hand-carrying of the luggage is effectuated by hand carry means, preferably a hand carry strap attached to the luggage. In the preferred embodiment, the luggage includes at least two straps or handles, a first hand carry means 42 affixed to the top 18 of the first compartment 14 and a second hand carry means 44 affixed to the side 26 of the first compartment 14. The straps or handles optionally are covered with material that resists slippage when gripping the strap, including, rubber, fabric, leather, rough coated plastic, and the like.

Figure 5:
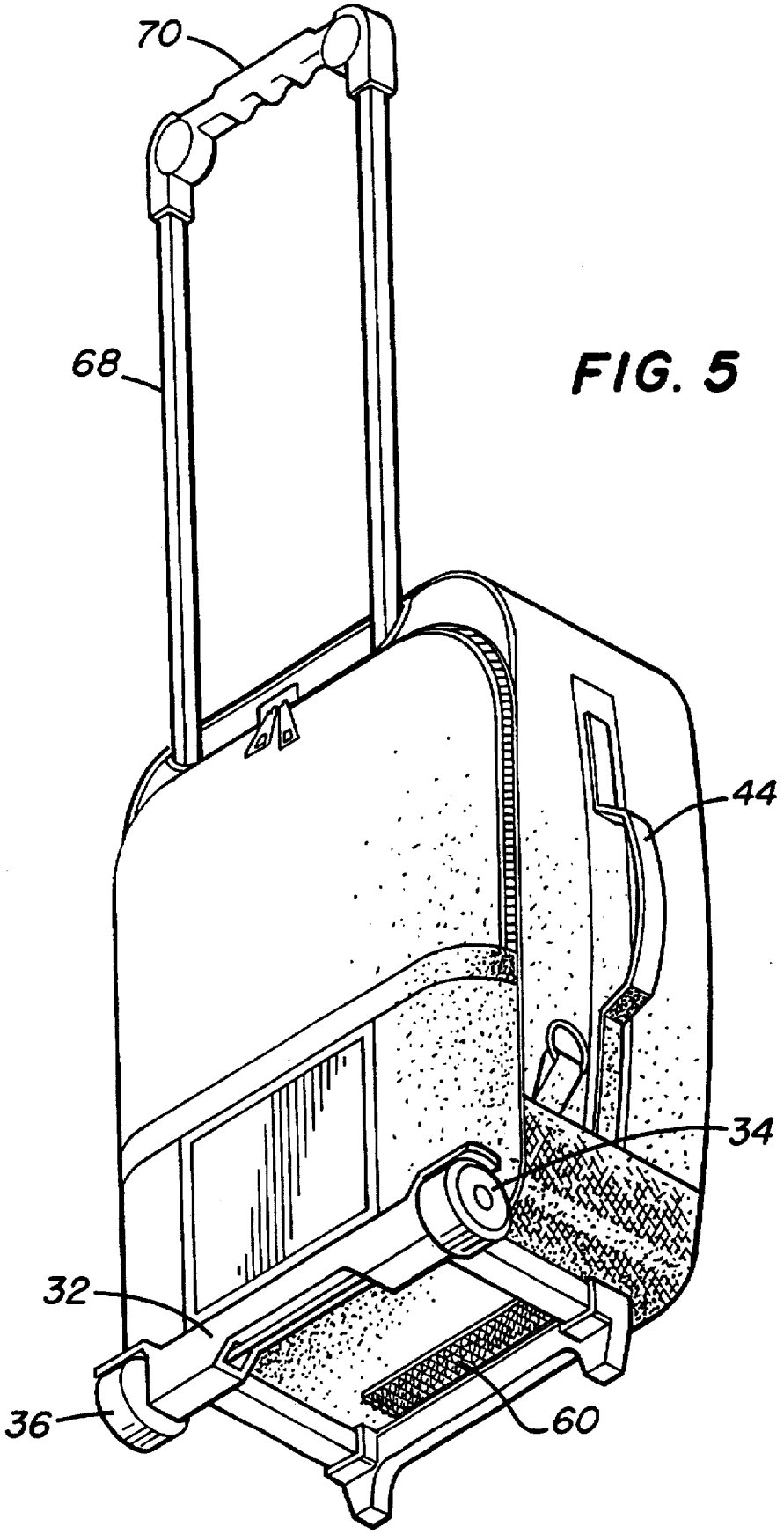
FIG. 5 is a back perspective view of the article of luggage in its wheeled format.

Shown in FIG. 2, the first cover 37 of the second compartment consists of a top edge 51, an intermediate edge 50 which engages the top edge 46 of the second compartment when in a closed position, and a bottom edge 52 which attaches to the bottom edge 48 of the second compartment when in an open or closed position. In a preferred closed cover embodiment, an inner side 54 which is proximal the cover's top edge 51 is folded at the cover's intermediate edge 50 and tucked into the second compartment, and an outer side 56 is exposed, as best shown in FIGS. 1 and 5. Preferably the outer side 56, which is the portion of the cover which rests between the user's back and the wheels, is composed of a thick padded material, while the inner side 54 is composed of a thin material so that it is not bulky and can easily be stored inside the second compartment. When the luggage is converted from its hand-carry format or wheeled format for use as a backpack, the first cover 37 is placed into an open position. As shown in FIG. 2, the first cover is released by disengaging the slide fastener 38 from the cover fastener.

Figure 4:
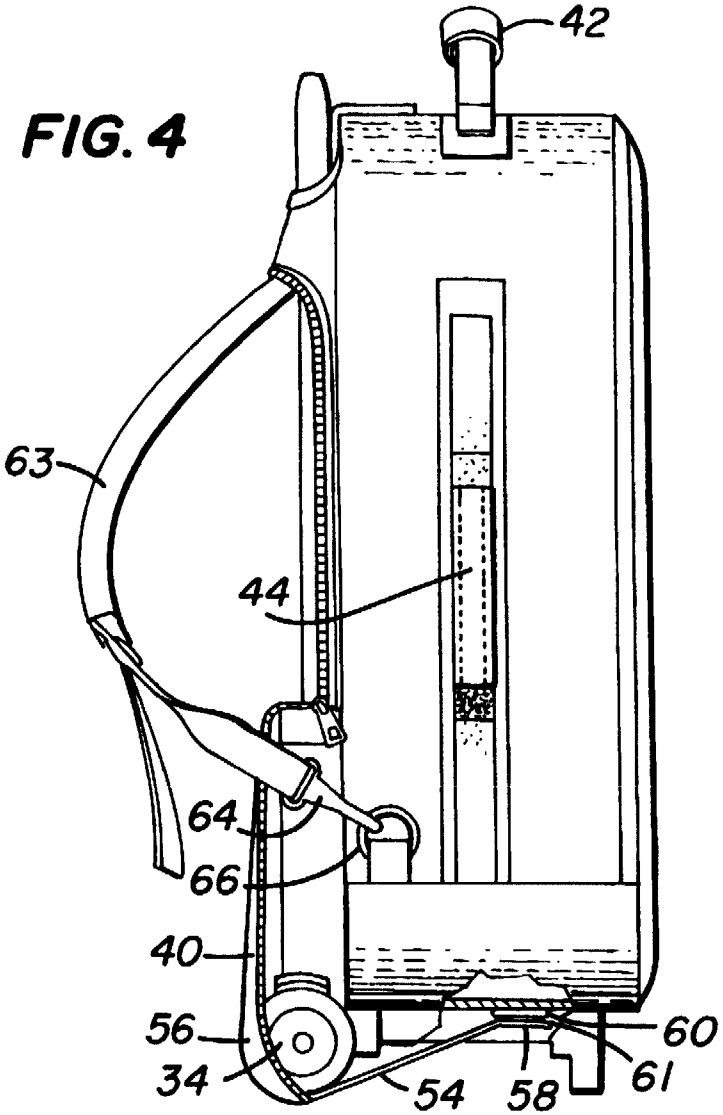
FIG. 4 is a side view of the article of luggage in its backpack format with its cover opened and fastened to the bottom.

FIGS. 3 and 4 show the luggage in its backpack format. As a backpack, the padded cover is opened by engaging a fastening means 58. The fastening means 58 may be any conventional attachment means such as hook and loop fastening pair such as Velcro®, snaps, or the like. If a hook and loop fastener is used, one hook and loop fastening pair 60 is positioned on the bottom of the first compartment adjacent to the intersection of the bottom and the front side. The other hook and loop fastening pair 61 is positioned on the inner side 54 of the first cover and adjacent to the top edge 51 of the first cover. As the cover is attached, the cover is wrapped at least partially around the wheels. In a preferred embodiment, the outer side 56 of the cover is wrapped around the portion of the wheels which face the back side of the luggage. In this manner the traveler's back, clothing and belongings are protected from debris on the wheels. In practice, protection from the wheels is especially of interest when the luggage is carried on the traveler's back.

In a preferred embodiment, bottom edge 48 of the second compartment is attached to the first compartment's back side 24 at a distance d above first edge 30. Distance d is chosen such that the height of outer side 56 as defined by intermediate edge 50 and bottom edge 52 is approximately equal to the sum of distance d and the height of wheels 34 and 36. Thus, when the padded cover is attached by engaging fastening means 58, padded outer side 56 extends down the length of the bottom portion of back side 24 and between wheels 34, 36 and the user's back, while inner side 54 can be brought between wheels 34 and 36 and attached at fastening means 58. This allows the padded outer side to cushion the user's back, while the thinner, less bulky inner side takes up less space along the bottom 20 of the pack. Because outer side 56 contacts only the portion of the wheels facing back 24 and not the portion of the wheels facing bottom 20, outer side 56 will not be damaged or torn by pressure between wheels 34 and 36 and the ground if the pack is rested on the ground while first cover 37 is fixed in the open position.

A pair of shoulder straps 62, 63 are positioned in the second compartment. Before the cover is opened, they are concealed by the cover. When the cover is opened, the shoulder straps 62, 63 are exposed and deployed from the second compartment. At one of the shoulder straps' ends, they are affixed to the second compartment, at a position close to the top edge 46. In a preferred embodiment, one of the shoulder straps 63 is affixed at the end opposite the end attached to the top edge to the first side 26 of the first compartment at its end opposite the end attached to the top edge. The second shoulder strap 62 is similarly attached at its other end to the second side 28 of the first compartment. The attachment to the first compartment can be by any convenient means, and preferably by a snap hook 64 and ring 66. In the preferred embodiment, each ring extends from either the first or second side of the first compartment, proximal the bottom and a snap hook is attached to the ends of the straps. Thus the snap hooks engage the rings. In addition, the shoulder straps optionally are partially padded and have an adjustment means for comfort to the traveler's shoulders.

In practice, the shoulder straps are worn over the traveler's shoulders such that the back side of the luggage is carried snug across the traveler's back. Since the cover protects the straps in this closed position during the times the luggage is in a wheeled or hand-carry format, the traveler is ensured that the shoulder straps are kept relatively free from filth.

As shown in FIG. 5, the luggage is conveniently converted back to a wheeled format. In this configuration, an elongated, extendable U-shaped member 68 is employed. The U-shaped member 68 is mounted on the first compartment at a position which is adjacent to the back side of the first compartment. In a resting position, the U-shaped member extends at its ends, from the bottom to the top of the first compartment. The cross member 70 of the U-shaped member extends out of the top of the first compartment. When the luggage is in the wheeled format, the U-shaped member is elongated from the top of the first compartment. The U-shaped member slides to a predetermined distance. In practice, the traveler grips the cross member of the extended U-shaped member and pulls or pushes the luggage by rolling the wheels across a surface. The luggage container may be tilted such that only the wheels and not the bottom is contacting the surface. The cross member optionally includes groves for placement of the traveler's fingers for convenient gripping of the cross member.

Figure 6:
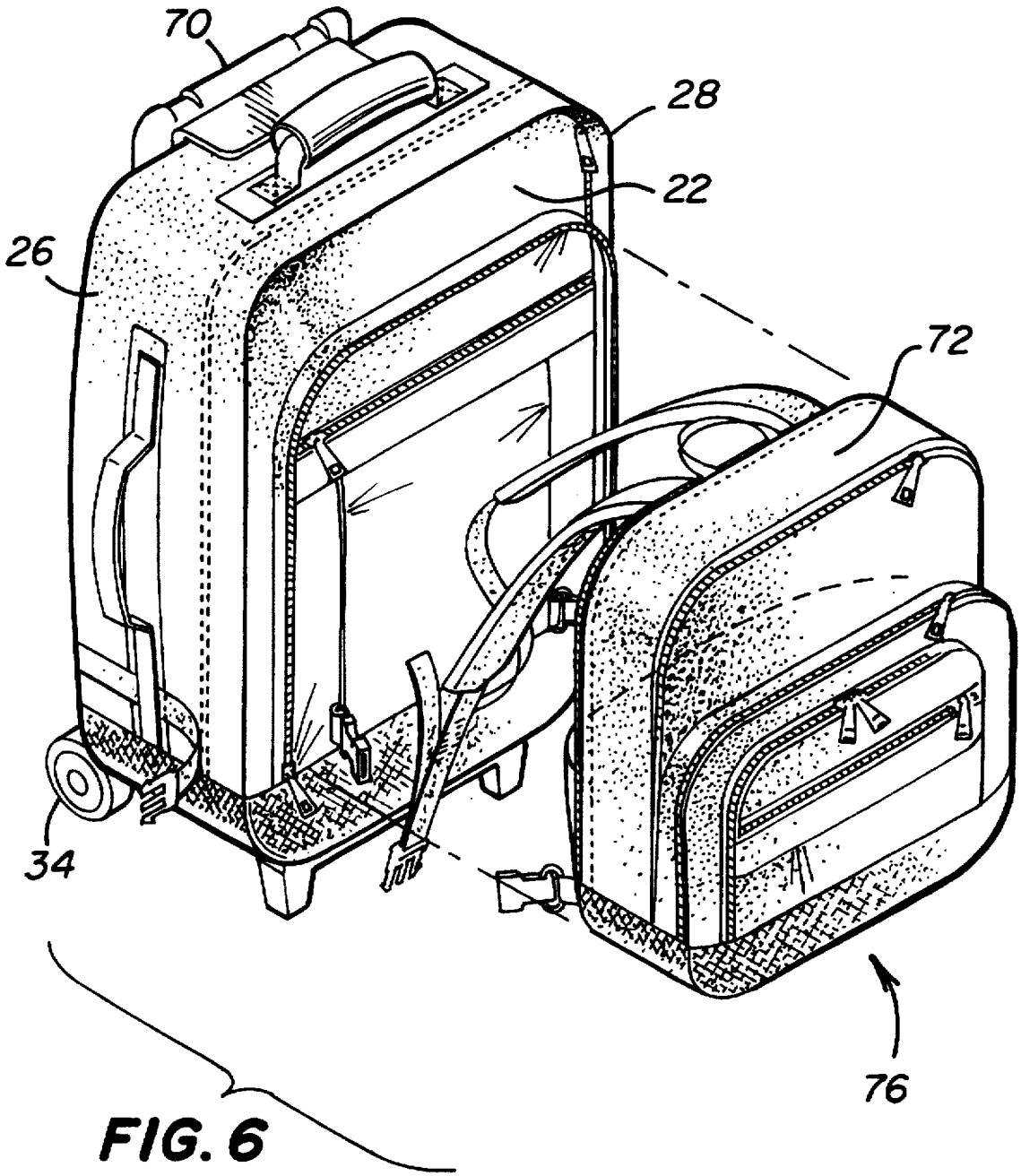
FIG. 6 is a perspective view of the article of luggage with the day pack shown released from the backpack.

The addition of multiple compartments is anticipated to be within the scope of the invention. In one embodiment shown in FIGS. 2 and 6, a third compartment 72 is provided and affixed to the front side 22 of the first compartment. The third compartment is optionally removable as a day pack 76.

All publications and patent applications cited in this specification are herein incorporated by reference as if each individual publication or patent application were specifically and individually indicated to be incorporated by reference.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A luggage container comprising:

a first compartment having a first edge;

a second compartment affixed to said first compartment;

a first cover operable to provide access to said second compartment;

an elongated axle affixed to said first edge of said first compartment;

a pair of wheels, one of said wheels rotatably mounted at one end of said elongated axle and the other of said wheels mounted at the other, opposite end of said axle;

a pair of shoulder straps positioned in and deployable from said second compartment, such that when said straps are deployed from said second compartment, the luggage container can be carried on a user's back, and wherein said first cover when opened covers only the portions of said wheels which are exposed to said user's back when said straps are deployed and said luggage container is worn on said user's back, whereby said first cover does not cover the portions of said wheels which contact the ground when said luggage container is rested upon the ground.

2. The luggage container of claim 1 wherein said first compartment defines a front side, a back side, a top, a bottom, a first side, and a second side;

wherein said second compartment is affixed to said back side; and, wherein said first cover includes fastening means to removably affix said first cover to said bottom.

3. The luggage container of claim 2, wherein said first edge is located at the intersection of the back side and the bottom of the first compartment.

4. The luggage container of claim 3 wherein said first cover is operably affixed to said second compartment by a slide fastener, positioned on said second compartment.

5. The luggage container of claim 4 wherein said second compartment defines a top edge and a bottom edge, said bottom edge proximate the first edge of said first compartment and wherein said first cover defines a first cover top edge and a first cover bottom edge, said first cover being affixed at said first cover bottom edge to said second compartment proximate the bottom edge of the second compartment.

6. The luggage container of claim 5 wherein each of said shoulder straps are affixed at one end thereof to said second compartment proximate the top edge, and further wherein each of said shoulder straps may be removably affixed to said first side of said first compartment and proximate the bottom of the first compartment, and the other of said shoulder straps may be removably affixed to the second side of said first compartment and proximate the bottom of the first compartment.

7. The luggage container of claim 6 further comprising:

a third compartment affixed to the front side of said first compartment;

said third compartment having a second cover; and, a day pack, said day pack removably positioned in said third compartment.

8. The luggage container of claim 7 wherein said first compartment defines an openable closure on the top thereof.

9. The luggage container of claim 5 wherein said first cover defines an inner side and an outer side, and closure means for removably attaching said first cover to the bottom of the first compartment, wherein said closure means comprises a hook and loop fastening pair, with one of the hook and loop fastening pair positioned on the bottom of the first compartment adjacent the intersection of the bottom and the front side thereof and the other of the hook and loop fastening pair positioned on the inner side of said first cover adjacent the first cover top edge.

10. The luggage container of claim 9 further comprising a first hand carry means operable from the top of said first compartment of carrying said luggage container.

11. The luggage container of claim 10 further comprising a second hand carry means affixed to the first side thereof.

12. The luggage container of claim 10 wherein the first hand carry means comprises an elongated extendable U-shaped member mounted in said first compartment adjacent the back side thereof and extending from the bottom of the first compartment thereof to the top thereof with the cross-member of the U-shaped member extending out of the top of the first compartment.

13. The luggage container of claim 12 wherein the elongated extendable U-shaped member is extendable a predetermined distance whereby said luggage container may be moved with said wheels in contact with a surface and with a user pulling or pushing said luggage carrier by means of said handle.

14. The luggage container of claim 1, wherein said first cover further defines an upper inner segment, a lower outer segment, and an intermediate edge, said upper inner segment connected to said lower outer segment at said intermediate edge, said first cover having an open position when operated to provide access to said second compartment and having a closed position when not providing access to said second compartment, such that when said first cover is in said closed position said upper inner segment may be folded at said intermediate edge into said second compartment.

15. The luggage container of claim 14, wherein said lower outer segment is formed of a thick padded material and said upper inner segment is formed of a thin material, such that when said first cover is in said open position said thick padded lower outer segment may be positioned to rest between said user's back and said wheels and said thin upper inner segment may be detachably fixed to said luggage container.

16. The luggage container of claim 1 wherein said first compartment defines a front side, a back side, a top, a bottom, a first side, and a second side;

wherein said second compartment defines a second compartment top edge, and a second compartment bottom edge;

wherein said second compartment is affixed to said back side;

wherein said first cover defines a first cover top edge and a first cover bottom edge;

wherein said first cover is affixed at said first cover bottom edge to said second compartment bottom edge;

wherein said first cover includes fastening means to removably affix said first cover to said bottom;

further comprising a third compartment affixed to said front side of said first compartment, said third compartment having a second cover;

further comprising a day pack, said day pack removably positioned in said third compartment;

further comprising an elongated extendable U-shaped member mounted in said first compartment adjacent said back side thereof and extending from said bottom of said first compartment thereof to said top thereof, said U-shaped member including a cross-member extending out of the top of the first compartment; and wherein said elongated extendable U-shaped member is extendable a predetermined distance whereby said luggage container may be moved with said wheels in contact with a surface and with a user pulling or pushing said luggage carrier by means of said handle.

17. A luggage container comprising:

a first compartment having a first edge;

a second compartment defining a lower edge, said second compartment affixed to said first compartment such that said lower edge of said second compartment is positioned at a distance d above said first edge of said first compartment;

an elongated axle affixed to said first edge of said first compartment;

a pair of wheels, one of said wheels rotatably mounted at one end of said elongated axle and the other of said wheels mounted at the other, opposite end of said axle, said wheels having a height;

a first cover affixed to said lower edge of said second compartment and operable to provide access to said second compartment, said first cover further defining an upper inner segment, a lower outer segment, and an intermediate edge, said upper inner segment connected to said lower outer segment at said intermediate edge, said lower outer segment having a height, said height approximately equal to the sum of said distance d and said height of said wheels, said first cover having an open position when operated to provide access to said second compartment and having a closed position when not providing access to said second compartment, such that when said first cover is in said closed position said upper inner segment may be folded at said intermediate edge into said second compartment;

a pair of shoulder straps positioned in and deployable from said second compartment, such that when said straps are deployed from said second compartment, the luggage container can be carried on a user's back, and wherein said first cover when opened covers at least a portion of said wheels with said straps deployed whereby the user's back is protected from said wheels.

18. The luggage container of claim 17, wherein said lower outer segment is formed of a thick padded material and said upper inner segment is formed of a thin material, such that when said first cover is in said open position said thick padded lower outer segment may be positioned to rest between said user's back and said wheels and said thin upper inner segment may be detachably fixed to said luggage container.

* * * * *